US006110028A

United States Patent [19]

Chung

[11] Patent Number: 6,110,028

[45] Date of Patent: Aug. 29, 2000

[54] RETARDING DEVICE OF A GRINDING MACHINE

[76] Inventor: Lee Hsin-chih Chung, No. 21-8, ShangSanChoWoo, Wuchang Li, ChungLi City, TaoYuan Hsine, Taiwan

[21] Appl. No.: 09/240,075

[22] Filed: Jan. 29, 1999

[51] Int. Cl.[7] ..... B24B 23/00

[52] U.S. Cl. ..... 451/359; 451/360

[58] Field of Search ..... 451/342, 344, 451/253, 359, 360, 420, 438, 508, 509, 510, 511, 915

[56] References Cited

U.S. PATENT DOCUMENTS

| | | | |
|---|---|---|---|
| 2,990,661 | 7/1961 | Hackett | 51/197 |
| 3,110,140 | 11/1963 | Reames | 51/195 |
| 4,138,804 | 2/1979 | Thielen | 51/168 |
| 5,018,314 | 5/1991 | Fushiya et al. . | |
| 5,458,532 | 10/1995 | Cannone | 451/353 |
| 5,584,753 | 12/1996 | Takahashi | 451/342 |

FOREIGN PATENT DOCUMENTS

| | | |
|---|---|---|
| 2081540 | 10/1992 | Canada . |
| 0694365 | 1/1996 | European Pat. Off. . |
| 4038502 | 6/1992 | Germany . |
| 2151412 | 7/1985 | United Kingdom . |

*Primary Examiner*—Timothy V. Eley
*Assistant Examiner*—Dung Van Nguyen
*Attorney, Agent, or Firm*—Ostrolenk, Faber, Gerb & Soffen , LLP

[57] ABSTRACT

A retarding device of a grinding machine comprises a casing and a grinding element, wherein the casing is securely installed with a circular flat plate around the periphery of the output shaft installed thereon. A fixing seat is installed on the rear side of the grinding element, and a fixing seat is installed with a plurality of friction elements so that the grinding element is combined with the output shaft, and thus the friction element contacts with the flat plate. Therefore, as the grinding element is rotating, the rotary speed of the grinding element is retarded by the friction forces between the friction elements and the flat plate.

4 Claims, 3 Drawing Sheets

RETARDING DEVICE OF A GRINDING MACHINE

FIELD OF THE INVENTION

The present invention relates to a retarding device of a grinding machine, and particularly to a retarding device having a compact structure and having the effect of retarding the rotation of a grinding element, therefore, the manufacturing cost is reduced and the weight is decreased.

BACKGROUND OF THE INVENTION

In the prior art electromotive grinding machine, a motor is mounted therewithin. The driving shaft of the motor is combined with an output shaft. The output shaft will extend outwards. The output shaft is further combined with a grinding element. The front surface of the grinding element is combined with a cutting tool, for example a emery cloth. When the grinding element is driven to rotate by the motor, the grinding element will grind the surface of a working piece to attain a required finishing level. In general, the rotary speed is very rapid. However, a higher actuating speed is often dangerous to users and a very high speed grinding is not practical. Therefore, other than installing a retarding gear outside the casing, there are no retarding methods in the prior art. However, the casing only has a finite space, and the retarding gear not only occupies much space, but also causes a complex structure and increases the manufacturing cost. Moreover, the retarding gear will increase the whole weight.

SUMMARY OF THE INVENTION

Accordingly, the primary object of the present invention is to provide a retarding device of a grinding machine, by contacts between the friction elements having a low friction coefficient and the flat plate. Therefore, as the grinding element is rotating, the rotary speed of the grinding element is retarded by the friction forces between the friction elements and the flat plates.

Another object of the present invention is to provide a retarding device of a grinding machine by which the manufacturing cost will reduce.

A further object of the present invention is to provide a retarding device of a grinding machine which is lighter than the prior art retarding device, and thus the user can operate easily.

Accordingly, the retarding device of a grinding machine of the present invention comprises a casing and a grinding element, wherein the casing is securely installed with a circular flat plate around the periphery of the output shaft installed thereon. A fixing seat is installed on the rear side of the grinding element, and the fixing seat has a plurality of installed friction elements so that the grinding element is combined with the output shaft, and thus the friction element contacts with the flat plate. Therefore, as the grinding element is rotating, the rotary speed of the grinding element is retarded by the friction forces between the friction elements and the flat plates.

The various objects and advantages of the present invention will be more readily understood from the following detailed description when read in conjunction with the appended drawing.

DETAILED DESCRIPTION OF THE PREFERRED EMBODIMENTS

Figure 1:
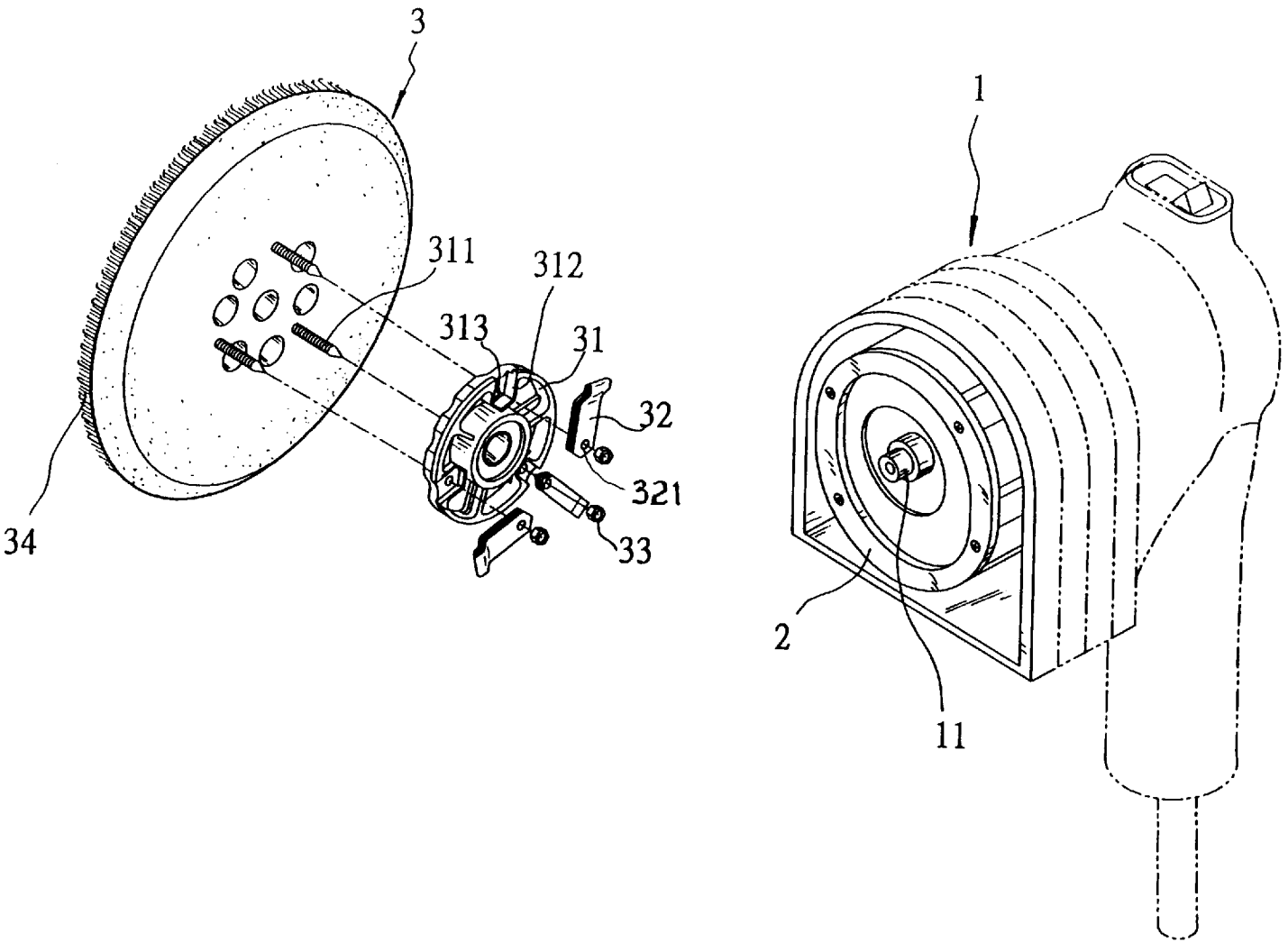
FIG. 1 is a perspective view showing the organization of the retarding device of the present invention.
Figure 2:
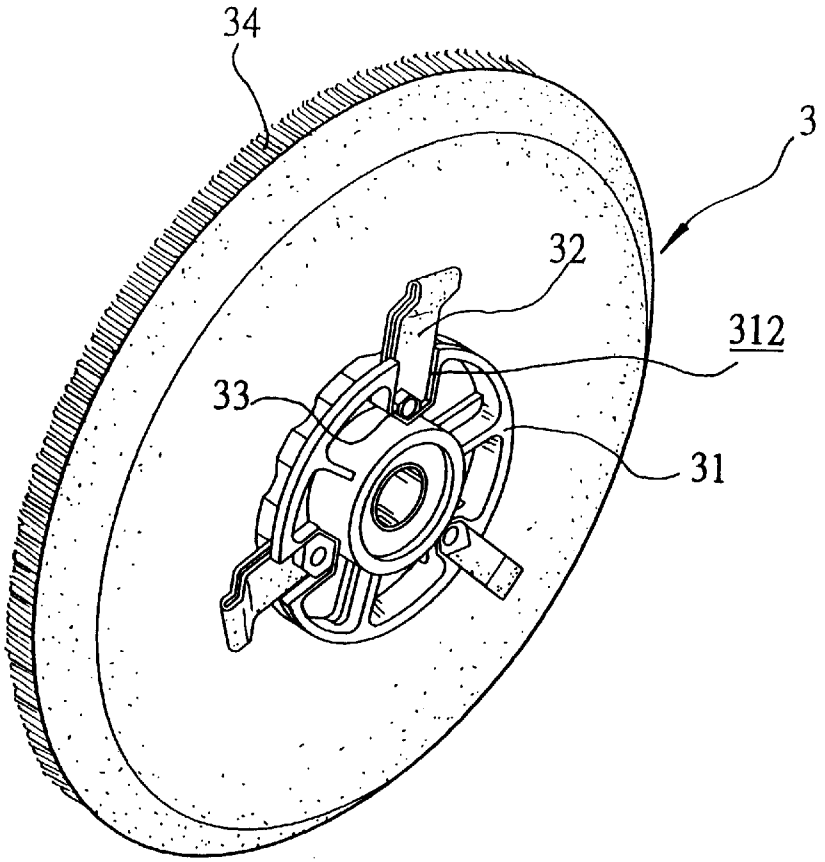
FIG. 2 shows a perspective view of the grinding element, the fixing seat, and the friction elements of the present invention.
Figure 3:
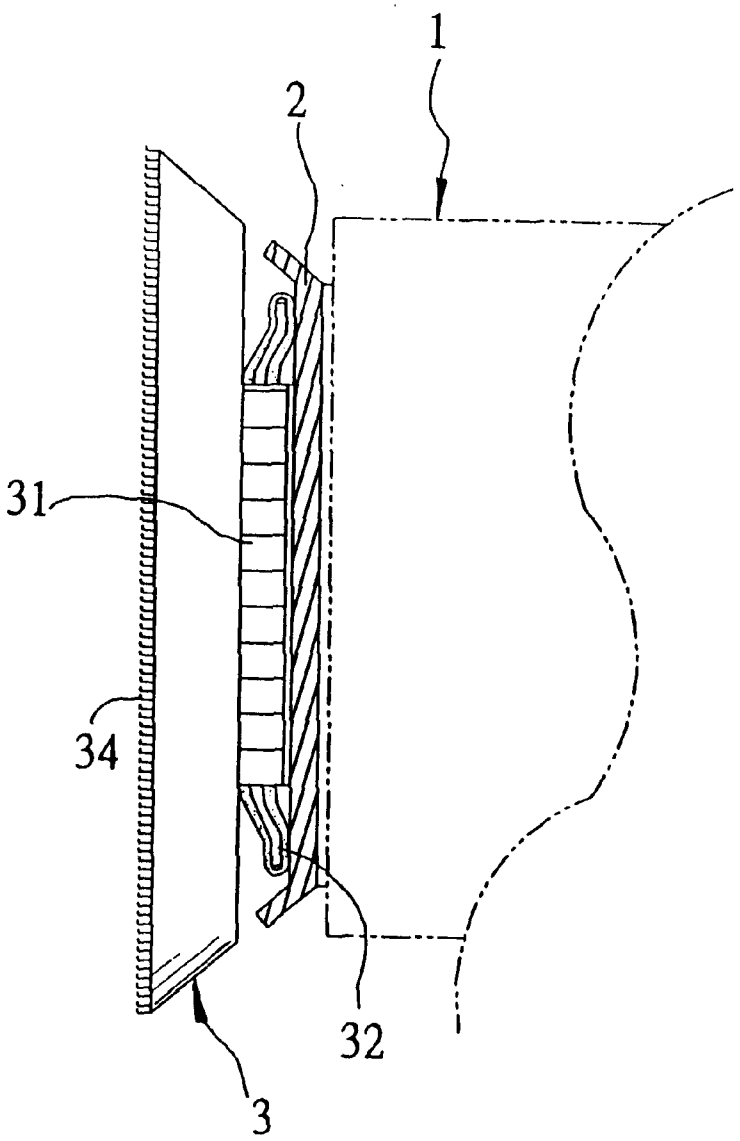
FIG. 3 is a plan cross sectional view of the retarding device of the present invention.

With reference now to FIGS. 1~3, the retarding device of a grinding machine of the present invention comprises a casing 1, a flat plate 2, a grinding element 3 and a plurality of friction elements 32. A motor is installed within the casing 1. The driving shaft of the motor is combined with an output shaft 11 which is extended to the outside of the casing 1 so that the output shaft 11 can be driven to rotate by the driving shaft of the motor. The casing 1 on the periphery of the output shaft 11 is firmly installed with a ring shape, flat and stationary plate 2 with a smooth surface. The rear side of the grinding element 3 is locked with a fixing seat 31 by screws, while the front surface of the grinding element 3 is combined with a cutting tool 34. A preferred embodiment of the cutting tool 34 is a grinding tool of emery cloth. A plurality of grooves 312 are formed on the periphery of the fixing seat 31. A penetrating hole 313 is formed on the bottom of the groove 312. The preferred embodiment of the friction element 32 is for example materials with low friction coefficients (such as Teflon, plastic, etc.) which is formed with a curved strip. The width thereof is exactly received by the groove 312. One end of the friction element 32 is installed with a penetrating hole 321. The friction element 32 is combined with the fixing seat 31 by inserting one end of the friction element 32 into a groove 312, then causing two holes 313 and 321 to matched with each others, inserting a screw 311 into the two holes 313 and 321, and then locking a nut 33 around the screw 311. Thus the friction element 32 is fixed in the groove 312.

By the aforementioned structure, when the grinding element 3 is assembled on the output shaft 11 protruded toward the outside of the casing 1. The convex portion of the friction element 32 will properly press the flat plate 2. At this time, when the grinding element 3 is driven to rotate, the friction element 32 will rotate. Thus, a friction force is generated between the friction element 32 and the flat stationary plate 2 so to reduce the rotary speed of the grinding element 3. Furthermore, by the structure of the present invention, since the retarding device is very compact and simple, the manufacturing cost can be decreased. Moreover, the whole weight is light, the user can operate easily.

Although the present invention has been described with reference to the preferred embodiments, it will be under stood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A retarding device of a grinding machine comprising a casing, a grinding element outside the casing, the grinding element is connected with an output shaft which extends from the casing, the output shaft is driven to rotate by a motor, a flat plate firmly installed on the casing around the output shaft, the grinding element has a rear side facing the plate, a fixing seat installed on the rear side of the grinding element, a plurality of friction elements at the fixing seat, a plurality of grooves on the periphery of the fixing seat, a respective friction element is received with each groove and is fixed therewithin; and the fixing seat supports the plurality of friction elements so that as the grinding element is connected with the output shaft, and the output shaft drives the grinding element to rotate, the friction elements contact the flat plate and rotation of the friction elements and the grinding element is retarded.

2. The retarding device of a grinding machine as claimed in claim 1, wherein the flat plate is a circular plate.

3. The retarding device of a grinding machine as claimed in claim 1, wherein each friction element has a curved shape including a curved portion thereof in contact with the flat plate, so that the griding element is retarded.

4. The retarding device of a grinding machine as claimed in claim 1, further comprising a plurality of screws securely installed on the rear surface of the grinding element, a plurality of holes each with respect to a respective one of the screws are formed within the grooves and the friction elements, and as the screws pass through the holes in the grooves and the friction elements, nuts lock the screws so that the friction elements are firmly secured in the grooves.

* * * * *